US005447453A

United States Patent [19]

Smith et al.

[11] Patent Number: 5,447,453

[45] Date of Patent: Sep. 5, 1995

[54] FIELD SERVICEABLE MINING CABLE COUPLER

[75] Inventors: Gary R. Smith, Delta; Greg E. Patton, Surrey; David R. Forshaw, Langley; David A. Peare, Surrey; Sean H. Peare, Surrey, all of Canada

[73] Assignee: Patton & Cooke Ltd., Surrey, Canada

[21] Appl. No.: 220,214

[22] Filed: Mar. 30, 1994

[51] Int. Cl.[6] ..... H01R 13/502

[52] U.S. Cl. ..... 439/701; 439/610; 439/519

[58] Field of Search ..... 439/92, 95, 135, 271, 439/274, 275, 607, 610, 519, 521, 695, 701

[56] References Cited

U.S. PATENT DOCUMENTS

| | | | |
|---|---|---|---|
| 4,402,566 | 9/1983 | Powell et al. . | |
| 5,129,843 | 7/1992 | Bowsky et al. | 439/685 |
| 5,131,858 | 7/1992 | Heimbrock | 439/181 |
| 5,246,376 | 9/1993 | Schuhl et al. | 439/610 X |
| 5,312,268 | 5/1994 | Sumida | 439/701 X |

OTHER PUBLICATIONS

In Service Worldwide TJB, 1990.

LP High Voltage Couplers Product Data Sheet. Adalet-Bulletin C.

*Primary Examiner*—Khiem Nguyen

*Attorney, Agent, or Firm*—Norman M. Cameron

[57] ABSTRACT

A mining cable coupler has a hollow, cylindrical body. There is an entrance fitting for an electrical cable at a first end of the body. A plate-like insulator mount extends over the body near the second end and has insulator receiving apertures with annular recesses extending thereabout and inwardly from the second end of the body. There is a plurality of separate, tubular insulators. Each insulator has an annular outer projection extending thereabout and received within one of the recesses of the insulator mount. There is an annular seal fitted between each recess and the insulator therein. There is an elongated electrical contact within each insulator. A metal member has a tube extending about each insulator. An inner portion of the member is against the insulator mount. The inner portion has an aperture for each insulator smaller than the annular outer projection thereof and closely fitted about each insulator adjacent the projection. Fasteners releasably secure the metal member to the insulator mount.

13 Claims, 4 Drawing Sheets

FIELD SERVICEABLE MINING CABLE COUPLER

BACKGROUND OF THE INVENTION

1. Field of the Invention

This invention relates to cable connectors of the type used for electrical cables in the mining industry and, in particular, to cable connectors having field serviceable insulators.

2. Description of Related Art

Heavy electrical cables arc commonly used in the mining industry for powering equipment. Such cables are connected together by cable couplers or connectors. These are used in pairs, one coupler having a plurality of sockets which receive a plurality of plugs in a second coupler. The couplers may be mounted on skids so they can be pulled about the job site by means of the attached cables.

The plugs and sockets, both of which comprise elongated conductors, are usually surrounded by an insulator, typically having a cylindrical opening surrounding each of the conductors. These insulators are subject to failure due to accident or environmental conditions. This can lead to arcing across adjacent conductors or between one or more conductors and ground. In the past it has not been possible to easily remedy this problem in the field. The coupler concerned had to be disconnected from the cable and sent to a shop in order to have the insulator replaced. The job was simply too inconvenient to carry out in the unfavourablc conditions of a mine.

SUMMARY OF THE INVENTION

It is an object of the invention to provide a coupler for mining cables wherein the insulators are field serviceable in the event of failure.

It is another object of the invention to provide a mining cable coupler wherein tubular inserts surrounding plugs or sockets can be individually removed instead of requiring replacement of an entire multiple insulator unit when problems arise.

It is another object of the invention to provide a mining cable coupler with replaceable insulators which are sealingly received in the coupler such that the interior of the coupler is protected from water, dust and other contaminants.

It is a further object of the invention to provide a mining cable coupler having an earth shield between the insulators which is perfectly grounded.

It is a still further object of the invention to provide a mining cable coupler which has a simple, rugged construction and which can be competitively produced and used reliably under the adverse conditions typically encountered by such devices.

In accordance with these objects, there is provided a mining cable coupler which includes a hollow body. There is an entrance fitting for an electrical cable at the first end of the body. There is an insulator mount for mounting a plurality of insulators adjacent a second end of the body. A plurality of separate, tubular insulators are mounted on the mount. An elongated electrical contact is within each of the insulators. The insulators are releasably secured to the mount.

For example, the mount may have an insulator receiving aperture for each insulator. The insulators extend through the apertures.

There may be annular seals fitted about each insulator within one of the apertures.

Each insulator may have an annular shoulder against one of the apertures in the mount. The mount may have an annular recess about each aperture, the shoulders being within the recesses. An O-ring may be received between each recess and the shoulder therewithin.

The insulators may have portions extending into the hollow body beyond the insulator mount, the connector having an earth shield extending from the mount between these portions of the insulators. The earth shield may have blade-like projections between adjacent insulators. Preferably the body, the mount and the earth shield are a one-piece member.

DESCRIPTION OF THE PREFERRED EMBODIMENTS

Figure 1:
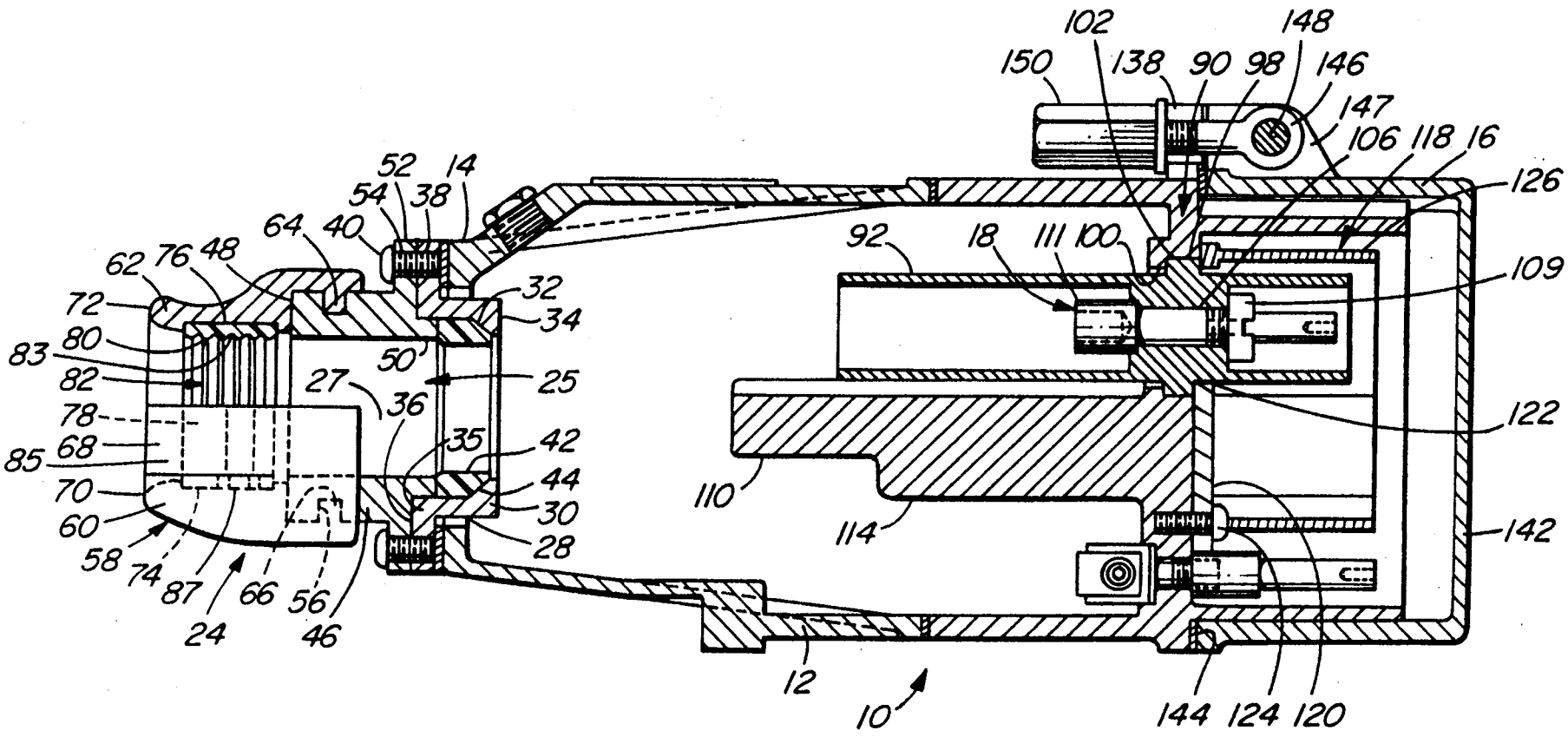
FIG. 1 is a side section of a mining coupler with male plugs according to an embodiment of the invention.
Figure 2:
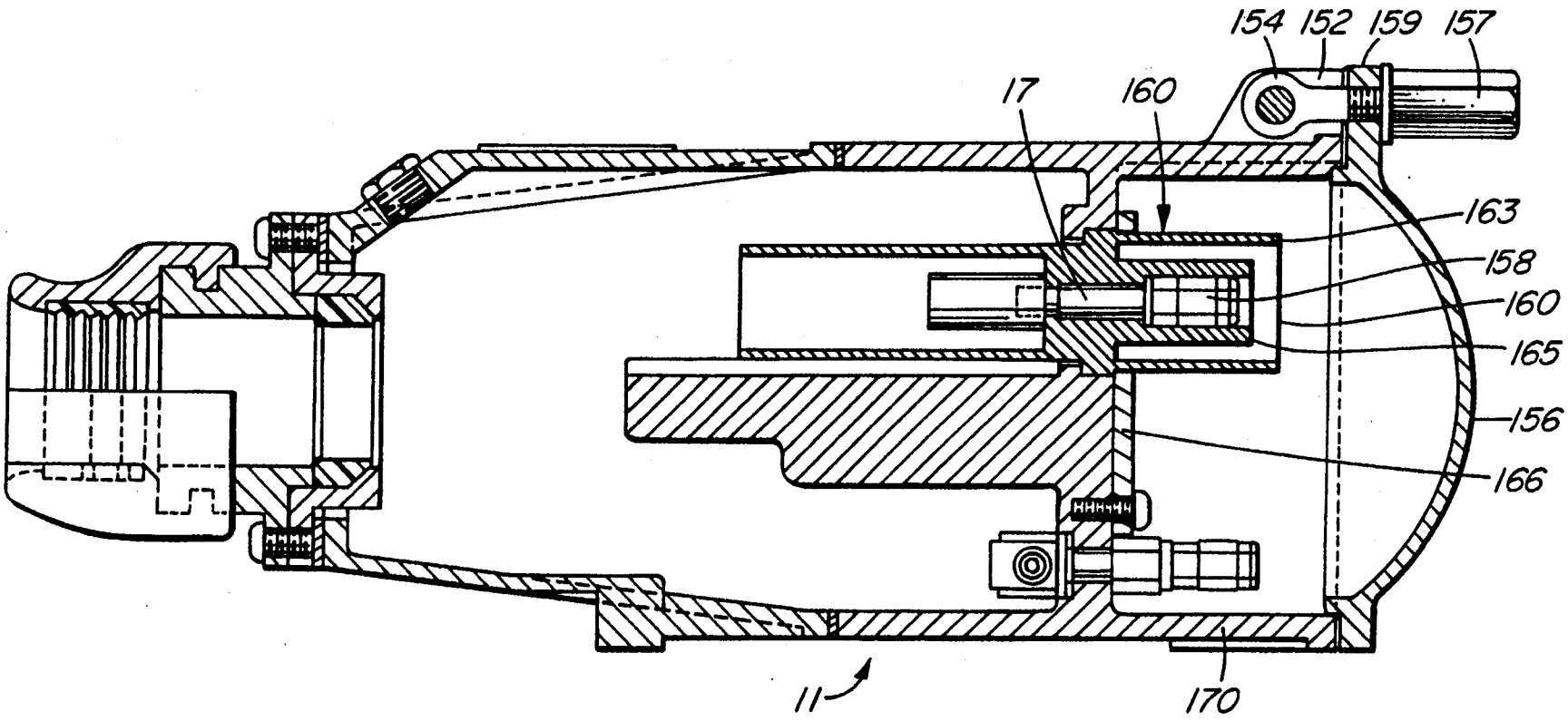
FIG. 2 is a side section of a mining cable coupler having female sockets according to another embodiment of the invention.
Figure 4:
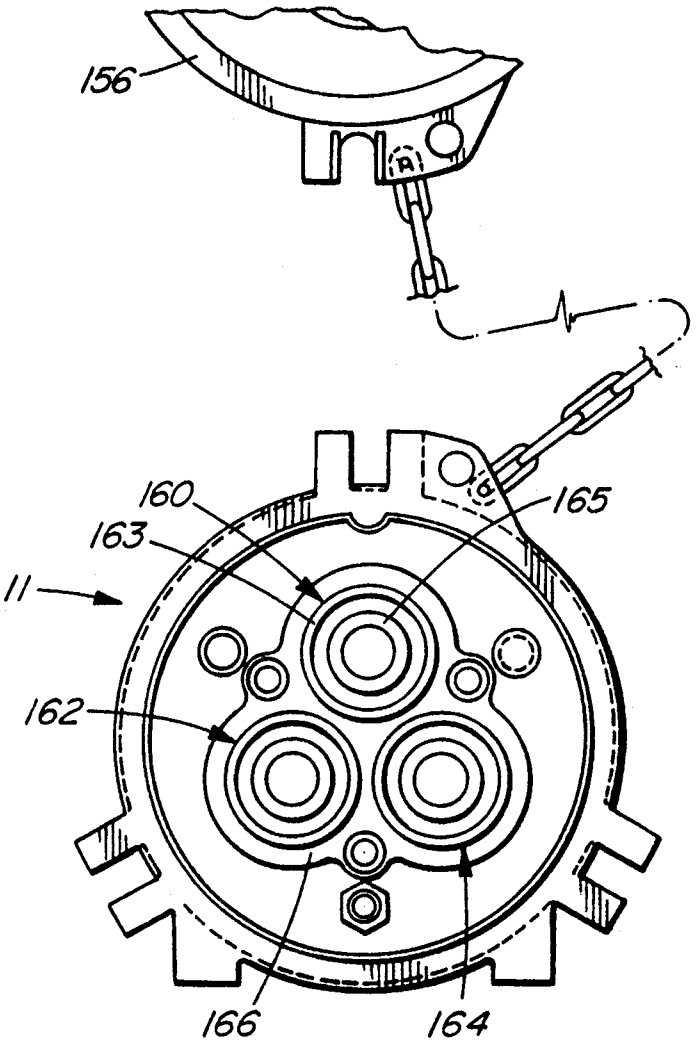
FIG. 4 is a front elevation of the embodiment of FIG. 2, with the cover thereof removed.
Figure 3:
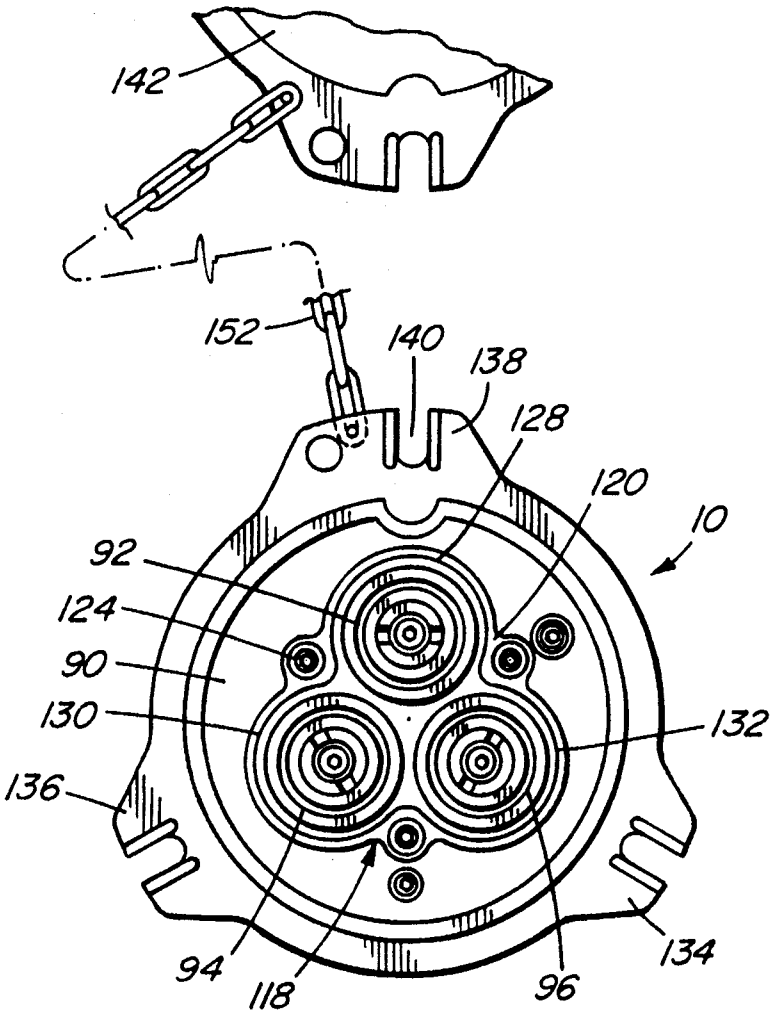
FIG. 3 is a front elevation of the embodiment of FIG. 1 with the cover thereof removed.

The coupler shown in FIG. 1 and 3 is generally the same as the embodiment of FIG. 2 and 4, the former being equipped with male plugs adapted to be received in female sockets of the latter. These embodiments are shown in FIG. 1 and 2 with protective covers in place. In normal use these covers would be removed and the complementary couplers mutually engaged to connect together two different mining cables. Because of their similarities, the embodiments are chiefly described with reference only to the embodiment of FIG. 1 and 3.

Referring first to FIG. 1, this shows a mining cable coupler 10 which has a hollow body 12 preferably of a metal, such as aluminum. The body in this embodiment is generally cylindrical and has a first end 14 and a second end 16.

There is an entrance fitting 24 at the first end of the body for receiving an electrical cable (not shown). The fitting has a tubular housing, shown generally at 25, with a cylindrical interior opening 27 for receiving the cable. The housing includes an annular seal support 30 on the entrance fitting 24 which extends through opening 28 in body 12. The seal support has an inner annular shoulder 32 adjacent its first end 34. The shoulder is bevelled in this example. The seal support has an annular, outwardly directed flange 35 adjacent its second end 36. The flange has a plurality of spaced-apart apertures 38 (only two shown) which receive a plurality of bolts 40 (only two shown) to connect the flange to the body 12. There is a resilient annular seal 42 received within the seal support 30. The seal may be of rubber or a synthetic elastomeric material for example. The seal has a bevelled edge 44 which abuts shoulder 32.

The housing 25 also includes an annular casing 46 which has a first end 48 and a second end 50. The second end is fitted within the second end 36 of the seal support and abuts the seal 42 on the side opposite the shoulder. The casing has an annular flange 52 on the exterior thereof between its ends which includes a plurality of apertures 54 (only two shown). The configuration of flange 52 and the arrangement of apertures 54 are similar to flange 35 and apertures 38 of the seal support. The flange of the seal support is bolted between the flange of the casing and end 14 of body 12. This serves to compress resilient seal 42 between second end 50 of the casing and shoulder 32. The seal 42 expands radially inwards, thus tightly gripping and scaling a cable extending through the entrance fitting into the coupler.

There is an annular groove 56 extending about the exterior of casing 46 adjacent its first end 48. The groove serves to rotatably receive a clamp assembly 58. The clamp assembly 58 includes a first semi-annular clamp member 60 and a second such clamp member 62 which are mirror images of each other. Together they form an annular clamp member extending about first end 48 of the casing and interior opening 27. Member 60 has a semi-annular ridge 66 which fits within the groove 56 extending about the casing. Clamp member 62 has a similar semi-annular ridge 64. The clamp assembly has an outer opening 68 defined by rounded ends 70 and 72 of the two clamp members.

The two clamp members have interior, semi-annular recesses 74 and 76 which respectively receive half sections 78 and 80 of a resilient annular member shown generally at 82. In this example, the annular member is of hard rubber or a similar synthetic although other resilient materials could be substituted. The member 82 has a series of rounded, spaced-apart ridges 83 extending about the inner surface thereof. In the illustrated embodiment there are five such ridges, but the number is not critical. Clamp member 62 only is in section in FIG. 1 to show the member 82 and the interior of the clamp member.

Each clamp member has a pair of bosses 85 on opposite sides thereof. These bosses are adjacent each other and have corresponding apertures to receive a bolt 87 serving to clamp the members together. There are similar bosses and another bolt on the opposite side of both clamp members.

In use, seal support 30 with seal 42 fitted therein is inserted into the opening 28 of the body 12. The casing 46 is fitted over the end of the cable which is then inserted through the opening in the seal and seal support and pushed into the coupler to the extent necessary for connecting it to the plugs 18 (or sockets 17 in the case of coupler 11 in FIG. 2). End 50 of the casing is then inserted into the seal holder against the seal and is clamped in place. Bolts 40 extend through the bolt holes in the flanges in the casing and seal holder respectively, thus causing the seal to expand inwardly to tightly grip the jacket of the cable. The two clamp members 60 and 62 are then positioned about the cable with the sections 78 and 80 of the resilient, annular member 82 received therein. The bolts 87 are then inserted through the bosses 85 on the clamp members and tightened to secure the cable tightly with the annular ridges 83 of the member 82.

More conventional entrance fittings could be substituted for the one described above.

There is an insulator mount, shown generally at 90, for mounting a plurality of insulators, such as insulator 92 shown in FIG. 1, adjacent the second end 16 of the body. In this embodiment there are three such insulators 92, 94 and 96, shown in FIG. 3, as is conventional for mining cable couplers of this type. The insulators are conventionally arranged at the corners of an equilateral triangle. The insulators are tubular, as best appreciated from insulator 92 in FIG. 1 which shows one of the insulators in section. Each insulator has an annular shoulder or outer projection 98, shown only for insulator 92 in FIG. 1.

Referring to insulator mount 90 in more detail, this comprises a round, plate-like member in this embodiment as seen best in FIG. 3. There are however three substantial, circular apertures through the insulator mount for receiving the insulators 92, 94 and 96. Aperture 100 for insulator 92 can be seen in FIG. 1. The other apertures are the same, and are spaced-apart at the corners of an equilateral triangle to correspond with the positions of the insulators shown in FIG. 3. There is an annular recess 102 about each aperture, 100 on the side of mount 90 facing end 16 of the body. The recess is dimensioned to be complementary in shape and configuration to the shoulder 98 of each insulator so the shoulder can be closely received within the recess as shown for insulator 92 in FIG. 1 and 5.

Figure 5:
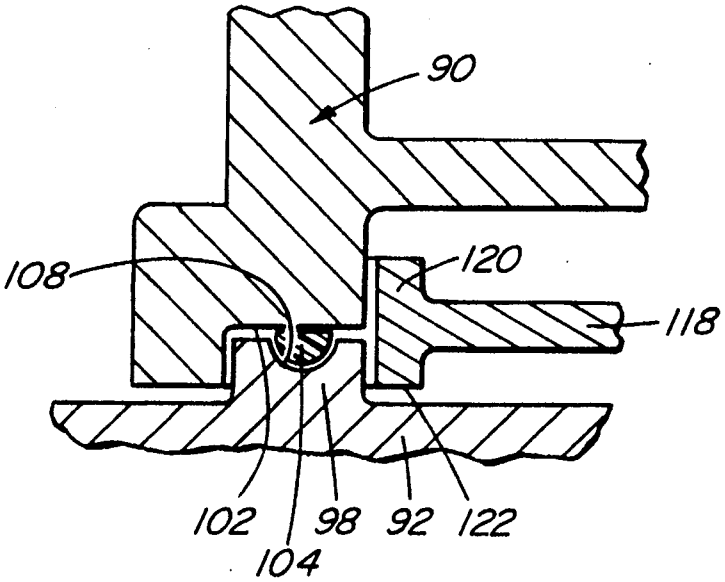
FIG. 5 is an enlarged, fragmentary section of a portion of an insulator, a mount therefor and an O-ring therebetween of the embodiment of FIG. 1.

There is an O-ring 104 compressingly received between each insulator and the corresponding aperture in mount 90 as shown only for insulator 92 in FIG. 5. The O-ring is received within a smaller curved groove 108 within the shoulder 98 of each insulator and compressed against the recess 102 of the mount. These O-rings serve to seal about each of the insulators and thereby seal the inside of the body 12 from moisture, dirt and other contaminants.

As mentioned above, a plug 18 is fitted within each of the insulators in coupler 10 and extends through aperture 106 therein. Slotted, annular nuts 109 are threadedly received over each plug. On the opposite side of the plug is an enlarged fitting 111 which receives one of the conductors from the cable (not shown). The fitting and the nut are larger than the aperture 106 and therefore allow the plug to be tightened in position within the insulator. Plugs of this type are known in the art.

Figure 6:
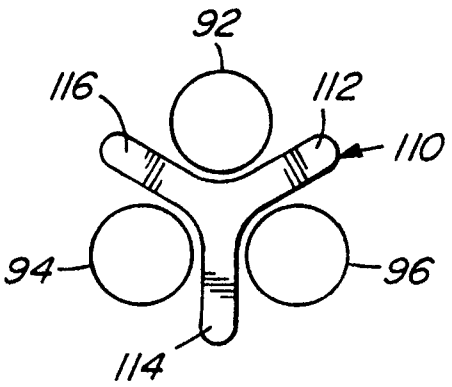
FIG. 6 is a simplified, rear elevation of the insulators and earth shield of the embodiments of FIG. 1 and 2.

It may be seen that the insulators extend inwardly into the hollow body 12 well beyond the plugs. There is an earth shield 110 extending inwardly from the insulator mount 90 into the body. As seen best in FIG. 6, earth shield 110 has three blade-like projections 112, 114 and 116, each extending between one pair of the insulators 92, 94 and 96. In this embodiment the projections are 120° apart. The earth shield is spaced-apart from the insulators. This type of earth shield and the general arrangement is known in the art and is therefore not described in further detail. However, conventionally the earth shield is a separate component and consequently subject to imperfect grounding. In this preferred embodiment the earth shield 110, the insulator mount 90 and the body 12 comprise a single piece of metal and may be formed by casting aluminum, for example. This means that the earth shield has a perfect ground with respect to the rest of coupler 10. The coupler also includes a securing member 118 which serves in part to releasably secure the insulators to mount 90. The member 118 has an inner portion 120, shown in FIG. 1 and 3, which is held tightly against mount 90 by releasable fasteners, in this instance by three bolts 124. There are three apertures 122 extending through inner portion 120 corresponding in position to each of the insulators 92, 94 and 96. As shown best in FIG. 1 and FIG. 5, the apertures 122 are just slightly larger than the insulators apart from the shoulders 98 thereof. The apertures are smaller than the shoulders and therefore the securing member 118 presses against the shoulders of the insulators to releasably secure them within the grooves 102 in the insulator mount 90 when the bolts 124 are tightened. Inner portion 120 then tightens against both the shoulders 98 of the insulators and the mount 90 as best shown in FIG. 5.

The member 118 has an outer portion 126 formed into three tubes 128, 130 and 132 which extend about the insulators 92, 94 and 96 respectively and spaced-apart outwardly therefrom. This structure is best seen with reference to FIG. 3. The securing member 118 is made of metal and the outer portion serves as a ground shield extending about the insulators. If one of the insulators fails, any arcing occurs to the shield and thus to ground, rather than across to one of the other insulators and the conductor therein. It may be seen that the outer portion 126 extends closer to end 16 of the coupler than do the ends of the insulators.

There are three pairs of spaced-apart lugs, 134, 136 and 138 extending outwardly from body 12 of coupler 10 adjacent end 16. The structure is best seen in FIG. 3. There is a slot 140 between each pair of lugs as seen for the pair of lugs 138.

FIG. 1 shows a cap 142 fitted over the second end 16 of the body 12 up against shoulder 144 thereof. The cap has three eye bolts 146 secured to pairs of lugs 147 by pins 148. The eye bolts are spaced-apart in positions corresponding to the slots 140 on the body 12. A nut 150 is threadedly received on each of the eye bolts. The eye bolts can be rotated into the slots 140 and the nuts 150 tightened to secure the cap 142 in place over the coupler as shown in FIG. 1. A chain 152 may be used to connect the cap to the body 12, as seen in FIG. 3, so the cover is not lost when removed from the end 16 of the body as shown in FIG. 3. The cover is thus removed in order to connect coupler 10 with coupler 11 shown in FIG. 2.

Coupler 11, as mentioned above, is generally similar to coupler 10 and therefore is described only with respect to the differences therebetween. In the case of coupler 12, its spaced-apart lugs 152 are provided with eye bolts 154 in the same manner as cap 142. Cap 156 for this coupler is instead provided with the spaced-apart lugs 159 which receive the eye bolts therebetween. The eye bolts are provided with nuts 157 similar to the nuts 150 of 1he previous embodiment. The cap 156 is removed in order to connect coupler 10 to coupler 11. Coupler 11 has three female sockets 17 having outer ends 158 capable of receiving the male plugs 18 of coupler 10. There are three such plugs which are arranged and spaced-apart in the same manner as the male plugs.

Insulators 160, 162 and 164 are slightly different than the insulators of the previous embodiment. The outer ends of the insulators have an outside tubular portion 163 and inside tubular portion 165. The inside tubular portion of each insulator fits about the outer end 158 of one of the sockets 17. The outside tubular portion 163 is spaced-apart outwardly from the inside portion 165 a sufficient distance to receive one of the insulators of coupler 10 therebetween when the couplers 10 and 11 are fitted together.

It may also be seen that securing member 166 of this embodiment is flat and plate-like, as best seen in FIG. 2, having no outer tubes surrounding the insulator. Instead, the tubes 128, 130 and 132 extend about the outside tube portions 126 and 163 of both sets of insulators when the couplers are mutually engaged. After the covers are removed, the couplers can be fitted together, end 170 of coupler 11 being larger in diameter than end 16 of coupler 10 so the latter receives the former therein up to shoulder 144 of coupler 10. The eye bolts 154 of coupler 11 are received between the pairs of lugs on coupler 10 and the nuts 157 are tightened to hold the couplers together.

It will be understood by someone skilled in the art that many of the details provided above are by way of example only and are not intended to limit the scope of the invention which is to be interpreted with reference to the following claims.

What is claimed is:

1. A mining cable coupler, comprising:

a hollow body having a first end and a second end;

an entrance fitting for an electrical cable at the first end of the body;

insulator mounting means for mounting a plurality of insulators adjacent the second end of the body the mounting means including a plate-like member having a plurality of insulator receiving apertures;

a plurality of tubular insulators mounted on said mounting means each of the insulators extending through one of said apertures and having a shoulder against the one of said apertures in the member;

an O-ring fired about each said insulator within one of said apertures, an elongated electrical contact within each said insulator; and means for releasably securing each said insulator to the mounting means including a securing member with apertures fitted over the insulators and against the plate-like member, the apertures in the securing member being smaller than the shoulders on the insulators, and fasteners connecting the securing member to the plate-like member.

2. A coupler as claimed in claim 1, wherein the member has an annular recess about each said aperture, the shoulders being within the recesses.

3. A coupler as claimed in claim 2, wherein each said O-ring is received between each said recess and the shoulder therewithin.

4. A coupler as claimed in claim 1, wherein the fasteners are threaded fasteners.

5. A coupler as claimed in claim 1, wherein the securing member has a tube surrounding each said insulator and outwardly spaced-apart therefrom.

6. A coupler as claimed in claim 5, wherein the securing member is of metal.

7. A coupler as claimed in claim 1, wherein the insulators have portions extending into the hollow body beyond the insulator mounting means, an earth shield extending from the mounting means between said portions of the insulators.

8. A coupler as claimed in claim 7, wherein the earth shield has blade-like projections between adjacent said insulators.

9. A coupler as claimed in claim 8, wherein the coupler has three said insulators having centers at the corners of an equilateral triangle, the earth shield having three blade-like projections spaced-apart 120° from each other.

10. A coupler as claimed in claim 1, wherein the contacts are plugs.

11. A coupler as claimed in claim 1, wherein the contacts are sockets.

12. A coupler as claimed in claim 7, wherein the body, the mounting means and the earth shield are a one-piece member.

13. A mining cable coupler, comprising:

a hollow, cylindrical body having a first end and a second end;

an entrance fitting for an electrical cable at the first end of the body;

a plate-like insulator mount extending across the body adjacent the second end and having three insulator receiving apertures with annular recesses extending thereabout and inwardly from the second end of the body, the apertures being spaced-apart at the corners of an equilateral triangle;

a plurality of separate, tubular insulators, each said insulator having an annular outer projection extending thereabout and received within one said recess of the insulator mount, the insulators extending inwardly into the body from the insulator mount;

an annular seal fitted between each said recess in the mount and the insulator therein;

an elongated electrical contact within each said insulator, each said contact having means within the body for connecting said each contact to a conductor of said electrical cable;

a ground shield extending inwardly into the body from the insulator mount and having three blade-like projections, each said projection extending between a pair of said insulators, the body, the insulator mount and the shield being of one piece of metal;

a metal member having a tube extending about each insulator and spaced-apart therefrom, extending from the insulator mount towards the second end of the body, and having an inner portion against the insulator mount, the inner portion having an aperture for each said insulator which is smaller than the annular outer projection thereof and closely fitted about said each insulator adjacent said projection; and fasteners releasably securing the metal member to the insulator mount.

* * * * *